US008147623B2

(12) United States Patent
Asada et al.

(10) Patent No.: US 8,147,623 B2
(45) Date of Patent: Apr. 3, 2012

(54) STEEL PIPE AS FUEL INJECTION PIPE

(75) Inventors: Kikuo Asada, Mishima (JP); Osamu Endo, Izu (JP); Katsunori Nagao, Osaka (JP); Keisuke Hitoshio, Osaka (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 419 days.

(21) Appl. No.: 12/244,641

(22) Filed: Oct. 2, 2008

(65) Prior Publication Data

US 2009/0078341 A1 Mar. 26, 2009

Related U.S. Application Data

(63) Continuation of application No. PCT/JP2007/057949, filed on Apr. 11, 2007.

(30) Foreign Application Priority Data

Apr. 13, 2006 (JP) ..... 2006-110471

(51) Int. Cl.
*C22C 38/02* (2006.01)
*C22C 38/04* (2006.01)

(52) U.S. Cl. ..... 148/320; 148/333; 148/334; 148/909

(58) Field of Classification Search ..... 148/320, 148/590–594, 330–336, 909
See application file for complete search history.

(56) References Cited

U.S. PATENT DOCUMENTS

| | | | | |
|---|---|---|---|---|
| 5,887,628 | A | 3/1999 | Usui | |
| 2003/0172773 | A1* | 9/2003 | Sato et al. | 75/10.48 |
| 2005/0081962 | A1* | 4/2005 | Matsuzaki et al. | 148/319 |

FOREIGN PATENT DOCUMENTS

| | | | |
|---|---|---|---|
| JP | 59-179717 | A | 10/1984 |
| JP | 07-102317 | | 4/1995 |
| JP | 08-309428 | | 11/1996 |
| JP | 09-057329 | | 3/1997 |
| JP | 2003-160838 | A | 6/2003 |
| JP | 2007-031765 | | 2/2007 |
| KR | 10-0256161 | B1 | 6/2000 |
| RU | 2 152 450 | C1 | 7/2000 |
| RU | 2 167 954 | C2 | 5/2001 |

OTHER PUBLICATIONS

Machine-english translation of Japanese patent 09-067624, Abe Toshiharu et al., Mar. 11, 1997.*
Machine-English translation of Japanese patent 2004-068095, Kono Osamu et al., Mar. 4, 2004.*
International Preliminary Report on Patentability from the International Bureau of WIPO, dated Nov. 17, 2008.
Zhengbang, L., "Super Clean Steels and Zero Non-Metallic Inclusion Steels," *Special Steel*, 25(4):24-27 (2004).
International Search Report in corresponding PCT/JP2007/057949 dated May 22, 2007.
Written Opinion in corresponding PCT/JP2007/057949 dated May 22, 2007 (in Japanese).

* cited by examiner

*Primary Examiner* — Deborah Yee
(74) *Attorney, Agent, or Firm* — Marshall, Gerstein & Borun LLP

(57) ABSTRACT

To provide a steel pipe as a fuel injection pipe with high material strength, high internal pressure limit free from fatigue failure, prolonged fatigue life, and high reliability. A steel pipe as a fuel injection pipe of 500 N/mm$^2$ or higher tensile strength comprising, by mass, C: 0.12 to 0.27%, Si: 0.05 to 0.40%, and Mn: 0.8 to 2.0%, and the balance being Fe and impurities, the contents of Ca, P, and S in the impurities being Ca: 0.001% or less, P: 0.02% or less, and S: 0.01% or less, respectively, characterized in that the maximum diameter of nonmetallic inclusions present in at least in a region extending from the inner surface of the steel pipe to a depth of 20 μm is 20 μm or less. Further, this steel pipe may contain, in place of a portion of Fe, at least one selected from among Cr: 1% or less, Mo: 1% or less, Ti: 0.04% or less, Nb: 0.04% or less, and V: 0.1% or less.

2 Claims, No Drawings

STEEL PIPE AS FUEL INJECTION PIPE

TECHNICAL FIELD

The present invention relates to a steel pipe used for injecting fuel into a combustion chamber, and more particularly to a steel pipe as a fuel injection pipe to supply fuel droplets into the combustion chambers of diesel engines.

BACKGROUND ART

Measures to prevent future depletion of energy resources are being made intensively including movements to promote energy saving and recycling of resources, and development of technology to make these movements possible. In recent years, an intense effort is being made worldwide to lower $CO_2$ emissions occurring from fuel combustion in order to prevent global warming.

Examples of internal combustion engines with low $CO_2$ emissions include diesel engines used in automobiles. However, even though $CO_2$ emissions are low, the diesel engine has a problem of black smoke emission. Black smoke occurs when there is not enough oxygen for the fuel being injected. That is, a dehydrogenation reaction occurs due to partial thermal decomposition of the fuel, producing a precursor to black smoke. This precursor thermally decomposes again, and agglomerates and coalesces, resulting in black smoke. This black smoke causes air pollution and adversely affects the human body.

Boosting the injection pressure of the fuel injected into the diesel engine combustion chamber can decrease black smoke. However, this requires the steel pipe used for fuel injection to have high fatigue strength. Examples of inventions related to the method for producing a steel pipe for this type of fuel injection include the following.

Patent document 1 discloses a method for producing a steel pipe for fuel injection in diesel engines where the inner surface of a hot rolled seamless steel pipe material is turned and polished by shot blasting, and then subjected to cold drawing. Using this production method reduces the depth of defects (irregularities, scab, tiny cracks, etc.) in the inner surface of steel pipe to within 0.10 mm, and therefore increases the strength of the steel pipe used for fuel injection.

[Patent document 1] JP H09-57329A

Although the steel pipe for fuel injection produced by the method disclosed in patent document 1 has high strength, the fatigue life does not match the strength of the steel pipe. Increasing the strength of the steel pipe material allows increasing the pressure load on the inner side of the steel pipe. However, the strength of the steel pipe material is not the only parameter that determines the internal pressure (hereinafter referred to as "internal pressure limit") that serves as a limit below which no fatigue failure occurs when pressure is applied to the inner side of the steel pipe. In other words, the desired or higher internal pressure limit cannot be obtained just by increasing the strength of the steel pipe material. The fatigue life is preferably as long as possible considering the reliability of the end product, but if the internal pressure limit is low, then the steel pipe will be subject to fatigue in high internal pressure applications, resulting in shortened fatigue life.

DISCLOSURE OF THE INVENTION

Problems to be Solved by the Invention

An objective of the present invention is to provide a highly reliable steel pipe as a fuel injection pipe with prolonged fatigue life by enhancing the material strength while maintaining high internal pressure limit.

Means to Solve the Problems

To solve the aforementioned problems, the present inventors made a detailed study of the relationship between the tensile strength of steel pipe material and internal pressure limit of steel pipe. Specifically, we prepared a plurality of steel pipes with varied material compositions and thus varied tensile strengths, in order to examine the relationship between tensile strength and internal pressure limit. During the examination of the internal pressure limit, some of the steel pipes suffered from fatigue failure, and we also examined the damaged portions.

The results of the examination revealed that when steel pipes composed of materials with substantially the same tensile strength that is below 500 N/mm$^2$ have different internal pressure limits, then the damage takes the same form, whereas when steel pipes composed of materials with substantially the same tensile strength that is equal to or higher than 500 N/mm$^2$ have different internal pressure limits, then the damage takes different forms depending on the degree of the internal pressure limit.

More specifically, when the tensile strength of the steel pipe material is 500 N/mm$^2$ or higher, a steel pipe with relatively large internal pressure limit has damage in a form similar to the form of the damage encountered when the tensile strength is below 500 N/mm$^2$. For a steel pipe with relatively small internal pressure limit, the breakdown originates in inclusions present in the vicinity of the inner surface of the steel pipe, which indicates that the internal pressure limit can be increased by suppressing these inclusions.

The present invention was completed on the basis of the above-described findings, and is summarized by a steel pipe as a fuel injection pipe described in the following (1).

(1) A steel pipe as a fuel injection pipe of 500 N/mm$^2$ or higher tensile strength comprised of, by mass, C, 0.12 to 0.27%, Si: 0.05 to 0.40%, and Mn: 0.8 to 2.0%, and the balance being Fe and impurities, the contents of Ca, P, and S in the impurities being Ca: 0.001% or less, P: 0.02% or less, and S: 0.01% or less, respectively, characterized in that the maximum diameter of nonmetallic inclusions present in at least in a region extending from the inner surface of the steel pipe to a depth of 20 μm is 20 μm or less.

The steel pipe as a fuel injection pipe described in (1) preferably contains, in place of a portion of Fe, at least one selected from among Cr: 1% or less, Mo: 1% or less, Ti: 0.04% or less, Nb: 0.04% or less, and V: 0.1% or less.

Effect of the Invention

The steel pipe of the present invention finds applications in supply of fuel into the combustion chambers of diesel engines. Using this steel pipe allows increasing the injection pressure of fuel into the combustion chambers, thereby enabling a reduction in black smoke emissions while reducing $CO_2$ emissions.

BEST MODE FOR CARRYING OUT THE INVENTION

As used herein, the steel pipe as a fuel injection pipe refers to a steel pipe that is subject to repeated application of pressure on the inner surface due to injection of fuel. In some cases, extremely high pressure applies to the internal surface for a short time, while in other cases high pressure constantly applies to the internal surface, with occasionally fluctuating degrees. The associated impacts cause extremely large fatigue to the material. The steel pipe as a fuel injection pipe of the present invention has fatigue properties capable of sufficiently withstanding even these pressurized applications.

Examples of applications of the steel pipe as a fuel injection pipe of the present invention include diesel engines employing a pressure-accumulation type fuel injection system, where the steel pipe is connected from the fuel pump to the common rail and thence to the injection nozzle, in order to guide fuel therethrough.

As described above, in diesel engines, fuel must be injected at extremely high pressure to suppress black smoke emissions, and therefore the inner surface of the steel pipe as a fuel injection pipe must be capable of withstanding this pressure. It will be readily appreciated that while the steel pipe of the present invention was developed for fuel injection pipes used in diesel engines, which are subject to high internal pressure, the steel pipe may also be used for fuel injection in direct-injection type gasoline engines.

The steel pipe as a fuel injection pipe of the present invention requires its steel pipe material to have a tensile strength of 500 N/mm$^2$ or higher. As described above, since the steel pipe as a fuel injection pipe is subject to high internal pressure, the steel pipe material must have a substantial level of tensile strength. The tensile strength of the steel pipe as a fuel injection pipe of the present invention is set to 500 N/mm$^2$ or higher because the tensile strength at this value is capable of sufficiently withholding the pressure applied to the inner side of the steel pipe from the pressurized fuel, and because the 500 N/mm$^2$ tensile strength serves as a boundary over or below which the form of damage from fatigue failure changes.

The form of damage will be described in detail with reference to specific examples in the examples section described below. When steel pipes have substantially the same tensile strength that is equal to or higher than 500 N/mm$^2$, the degree of the internal pressure limit varies depending on the form of damage. In the case where the form of damage originates in an inclusion, the internal pressure limit does not increase relatively to the tensile strength. The present invention can increase the internal pressure limit relatively to the tensile strength by satisfying other requirements.

In the steel pipe as a fuel injection pipe of the present invention, the maximum diameter of nonmetallic inclusions in the vicinity of the inner surface of the steel pipe must be within 20 μm. The term nonmetallic inclusion is an inclusion defined by 3131 in "Glossary of Terms Used in Iron and Steel" of JIS G0202. Precipitation of the nonmetallic inclusion is determined by the composition of the steel pipe and the production method, and the presence of precipitation can be confirmed by the microscopic test method for nonmetallic inclusion in steel specified in JIS G 0555; after cutting the steel pipe to obtain a cross section and polishing it, the polished surface is observed with an optical microscope.

In the steel pipe as a fuel injection pipe of the present invention, the maximum diameter, which is the diameter of the largest nonmetallic inclusion among numerous precipitated nonmetallic inclusions, must be 20 μm or less. This is because when this maximum diameter exceeds 20 μm, the form of the fatigue failure changes so that the nonmetallic inclusion with the maximum diameter exceeding 20 μm becomes the starting point for fatigue failure, which lowers the fatigue strength, in other words, the internal pressure limit.

Since the nonmetallic inclusions are not always in spherical shape, the maximum diameter of the nonmetallic inclusions is defined as (L+S)/2 where L denotes the length of the inclusion equivalent to the longitudinal diameter, and S denotes the length of the inclusion equivalent to the shorter diameter. The maximum diameter of the nonmetallic inclusions must be 20 μm or less at least in a region extending from the inner surface of the steel pipe, which is subject to high pressure, to a depth of 20 μm. Outside the region, a nonmetallic inclusion with a maximum diameter exceeding 20 μm will not become the start point for fatigue failure.

In order to reduce the maximum diameter of A type inclusions, S contained in the steel pipe may be set to 0.01% or less by mass. In order to reduce the maximum diameter of B type inclusions, the cross sectional area of the piece being cast may be increased. This is because during casting before solidification, large inclusions are floated out. The cross sectional area of the cast piece is preferably 200000 mm$^2$ or more.

In order to reduce the maximum diameter of C type inclusions, the Ca content in the steel pipe may be lowered. For this purpose, the Ca content in the steel pipe as a fuel injection pipe of the present invention is 0.001% or less by mass. Since Ca has the effect of coagulating the C type inclusions, restricting the Ca content prevents the C type inclusions from becoming large, which helps avoid adverse effects from C type inclusions.

Regardless of whether the A type, B type, or C type is concerned, slowing the casting speed (e.g., for continuous casting, a casting speed of 0.5 m/minute) suspends the lightweight nonmetallic inclusions as slag in the steel so that the nonmetallic inclusions themselves can be reduced in the steel.

The steel pipe as a fuel injection pipe of the present invention contains C, Si, and Mn. The following describes the operation and reason for limiting the content of these elements in the steel pipe as a fuel injection pipe of the present invention. In the following description, "%" for component content means "% by mass".

C: 0.12 to 0.27%

C is preferable for improving the strength of the steel pipe material. Improving the strength requires a C content of 0.12% or more. However, when the C content exceeds 0.27%, workability declines and forming into steel pipe becomes difficult. The C content is more preferably 0.12 to 0.2%.

Si: 0.05 to 0.40%

Si is preferable for deoxidizing the steel pipe material. Ensuring the deoxidizing effect requires a Si content of 0.05% or more. However, when the Si content exceeds 0.40%, the toughness might deteriorate.

Mn: 0.8 to 2.0%

Mn is preferable for improving the strength of the steel pipe material. Improving the strength requires a Mn content of 0.8% or more. However, a Mn content exceeding 2.0% promotes segregation and sometimes causes the toughness to deteriorate.

The composition of one steel pipe of the present invention also includes as the balance Fe and impurities in addition to the foregoing elements. However, Ca in the impurities must be 0.001% or less, as described above, and P and S must be restricted as described below.

P: 0.02% or less, S: 0.01% or less

Both P and S are impurity elements that adversely affect the hot workability and toughness, and therefore the P content and S content are preferably as low as possible in the steel. When the P content exceeds 0.02% or the S content exceeds 0.01%, the deterioration of the hot workability and toughness is remarkable.

Another steel pipe of the present invention contains at least one selected from the components described below in addition to the foregoing components.

Cr: 1% or less

Cr is not essential but preferable because of its effects of improving hardenability and abrasion resistance. To obtain these effects, the Cr content is preferably 0.3% or more. However, when the Cr content exceeds 1%, bainite is generated in large amounts and the toughness deteriorates.

Mo: 1% or less

Similarly, Mo is not essential but preferable because of its effects of improving the toughness as well as the hardenability. To obtain these effects, the Mo content is preferably 0.03% or more. However, when the Mo content exceeds 1%, bainite is generated in large amounts and the toughness deteriorates.

Ti: 0.04% or less

Ti is not essential but preferable because of its effects of improving the strength and toughness. To obtain these effects, the Ti content is preferably 0.005% or more. However, when the Ti content exceeds 0.04%, nitrogen compound inclusions form in the steel pipe, and the toughness deteriorates. The Ti content is more preferably 0.01 to 0.04%.

Nb: 0.04% or less

Nb is not essential but preferable because of its effects of improving the strength and toughness. To obtain these effects, the Nb content is preferably 0.005% or more. However, when the Nb content exceeds 0.04%, nitrogen compound inclusions form in the steel pipe, and the toughness deteriorates. The Nb content is more preferably 0.01 to 0.04%.

V: 0.1% or less

V is not essential but preferable because of its effects of improving the strength. To obtain this effect, the V content is preferably 0.01% or more. However, when the V content exceeds 0.1%, the toughness deteriorates.

EXAMPLES

To confirm the effects of the present invention, ten test pieces with the chemical compositions shown in Table 1 were produced. Each test piece was continuously cast at a respective casting speed and with a respective casting cross sectional area shown in Table 2, and subjected to Mannesmann piercing and rolling, elongation rolling by a mandrel mill, and sizing by a stretch reducer, thus hot forming a pipe of 34 mm in outer diameter and 25 mm in inner diameter. To draw this hot formed pipe, the end of the pipe was first swaged and coated with lubricant. The pipe was then drawn using a die and a plug, the pipe diameter was gradually reduced, the inner surface of the pipe was turned and polished, and diameter reduction processing was conducted as a finishing process to produce a steel pipe of 6.4 mm in outer diameter and 3.0 mm in inner diameter. Then, as a final process, heat treatment was carried out such that these steel pipes were transferred into an annealing furnace maintained at a temperature of 1000 C., held there for 20 minutes, and then left standing to cool. The resulting pipe had a microstructure comprising bainite and ferrite.

TABLE 1

| Test piece | Chemical compositions (mass %, the balance: Fe and impurities) | | | | | | | | | | | |
|---|---|---|---|---|---|---|---|---|---|---|---|---|
| No. | C | Si | Mn | P | S | Cr | Mo | Ti | Nb | V | Ca | Remarks |
| 1 | 0.17 | 0.31 | 1.38 | 0.014 | 0.005 | 0.06 | 0.01 | 0.020 | — | 0.07 | 0.0027 | Comparative |
| 2 | 0.17 | 0.31 | 1.38 | 0.014 | 0.005 | 0.06 | 0.01 | 0.020 | — | 0.07 | 0.0003 | Invention |
| 3 | 0.18 | 0.30 | 1.40 | 0.013 | 0.006 | 0.08 | 0.02 | 0.007 | — | 0.08 | 0.0032 | Comparative |
| 4 | 0.18 | 0.30 | 1.40 | 0.013 | 0.006 | 0.08 | 0.02 | 0.007 | — | 0.08 | 0.0008 | Invention |
| 5 | 0.19 | 0.32 | 1.36 | 0.016 | 0.006 | 0.05 | 0.19 | 0.018 | 0.033 | 0.06 | 0.0027 | Comparative |
| 6 | 0.19 | 0.32 | 1.36 | 0.016 | 0.006 | 0.05 | 0.19 | 0.018 | 0.033 | 0.06 | 0.0001 | Invention |
| 7 | 0.11 | 0.19 | 0.61 | 0.009 | 0.002 | 0.02 | — | — | — | — | 0.0030 | Comparative |
| 8 | 0.11 | 0.23 | 0.64 | 0.015 | 0.005 | 0.01 | — | — | — | — | 0.0035 | Comparative |
| 9 | 0.19 | 0.25 | 1.31 | 0.011 | 0.013 | 0.04 | 0.19 | 0.020 | 0.030 | 0.06 | 0.0002 | Comparative |
| 10 | 0.19 | 0.25 | 1.31 | 0.011 | 0.013 | 0.04 | 0.19 | 0.020 | 0.030 | 0.06 | 0.0012 | Comparative |

TABLE 2

| Test piece | | Casting speed | Casting cross section area | Maximum diameter of inclusion (μm) | | | Tensile strength | Internal pressure limit | |
|---|---|---|---|---|---|---|---|---|---|
| No. | Classification | (m/minute) | ($mm^2$) | A type | B type | C type | ($N/mm^2$) | (MPa) | Fatigue failure condition |
| 1 | Comparative | 2.3 | 28,000 | — | 18 | 33 | 560 | 190 | Fatigue failure from the inner surface of the pipe due to C type inclusion as start point |
| 2 | Invention | 0.5 | 220,000 | | 9 | 18 | 549 | 200 | Fatigue failure from the inner surface of the pipe |
| 3 | Comparative | 2.3 | 28,000 | 1 | 22 | 32 | 637 | 210 | Fatigue failure from the inner surface of the pipe due to C type inclusion as start point |
| 4 | Invention | 0.5 | 220,000 | 2 | 5 | 11 | 641 | 235 | Fatigue failure from the inner surface of the pipe |
| 5 | Comparative | 2.3 | 28,000 | — | 25 | 38 | 720 | 230 | Fatigue failure from the inner surface of the pipe due to C type inclusion as start point |
| 6 | Invention | 0.5 | 220,000 | — | 7 | 9 | 724 | 255 | Fatigue failure from the inner surface of the pipe |
| 7 | Comparative | 0.5 | 220,000 | — | — | 12 | 410 | 160 | Fatigue failure from the inner surface of the pipe |

TABLE 2-continued

| Test piece No. | Classification | Casting speed (m/minute) | Casting cross section area ($mm^2$) | Maximum diameter of inclusion (μm) A type | B type | C type | Tensile strength ($N/mm^2$) | Internal pressure limit (MPa) | Fatigue failure condition |
|---|---|---|---|---|---|---|---|---|---|
| 8 | Comparative | 2.3 | 28,000 | — | 20 | 40 | 412 | 150 | Fatigue failure from the inner surface of the pipe |
| 9 | Comparative | 0.5 | 220,000 | 25 | 6 | 7 | 711 | 210 | Fatigue failure from the inner surface of the pipe due to A type inclusion as start point |
| 10 | Comparative | 2.3 | 28,000 | 2 | 30 | 15 | 721 | 215 | Fatigue failure from the inner surface of the pipe due to B type inclusion as start point |

Part of each test piece was cut off as a sample, which was processed to a test piece size stipulated as No. 11 test piece in JIS and subjected to tensile test. This sample observed under an optical microscope on a region corresponding to a region extending from the steel pipe inner surface to a depth of 20 μm, and the precipitated inclusions were examined.

Table 2 shows the tensile strengths of the test pieces and the maximum diameter of the inclusions. The numbers in Table 2 correspond to those in Table 1. Test pieces numbered 1, 3, and 5 contain more Ca than test pieces numbered 2, 4 and 6, respectively. Table 2 shows that while the pieces numbered 1 and 2, 3 and 4, and 5 and 6 have substantially the same tensile strengths, the maximum diameter of the C type inclusions are larger in the pieces numbered 1, 3, and 5, which have larger Ca contents, than in the test pieces numbered 2, 4, and 6, respectively. Further, the maximum diameter of the A type inclusions are large in the piece numbered 9, and the maximum diameter of the B type inclusions are large in the piece numbered 10.

Each test piece was subjected to a fatigue test where pressure was applied to the inner side of the steel pipe. In the fatigue test, the minimum inner pressure was 18 MPa, the application of pressure was such that the load followed the form of a sine wave over time, and the maximum inner pressure at which no breakdown was observed against 107 times of repetition was assumed the internal pressure limit. When a breakdown occurred, the broken part was observed under an optical microscope.

Table 2 shows the internal pressure limits of the test pieces and breakdown conditions. Also in this case, the internal pressure limit is lower in the test pieces numbered 1, 3, and 5, which have larger Ca contents, than in the test pieces numbered 2, 4, and 6, respectively. For the breakage conditions, the fatigue failure took place from the inner surface of every steel pipe, which was subject to the highest pressure. However, in the test pieces numbered 1, 3, and 5, unlike the test pieces numbered 2, 4, and 6, the breakdown originates in the C type inclusions present in a region extending from the inner surface of each steel pipe to a depth of 20 μm. Also, in the test piece numbered 9, the fatigue failure originates in the A type inclusions present in a region extending from the inner surface of the steel pipe to a depth of 20 μm. Likewise, in the test piece numbered 10, the fatigue failure originates in the B type inclusions present in a region extending from the inner surface of the steel pipe to a depth of 20 μm.

As is clear from the above test results, among the test pieces with substantially the same tensile strength, those that minimize the maximum diameter of the nonmetallic inclusions can avoid fatigue failure originating in the nonmetallic inclusions, thereby raising the internal pressure limit.

INDUSTRIAL APPLICABILITY

The steel pipe as a fuel injection pipe of the present invention prevents fatigue failure that originates in nonmetallic inclusions present in the vicinity of the inner surface of the steel pipe, and therefore increases the internal pressure limit. Therefore, applying this steel pipe to a fuel injection pipe for supplying fuel into the combustion chambers of diesel engines will minimize fatigue even at substantially high injection pressure of fuel into combustion chamber.

The invention claimed is:

1. A seamless steel pipe as a fuel injection pipe, consisting essentially of:

by mass, C: 0.12 to 0.27%, Si: 0.05 to 0.40%, and Mn: 0.8 to 2.0%, and the balance being Fe and impurities, the contents of Ca, P, and S in the impurities being Ca: 0.001% or less, P: 0.02% or less, and S: 0.01% or less, respectively, wherein the steel pipe has a tensile strength of 500 $N/mm^2$ or higher and the microstructure of the steel pipe comprises bainite and ferrite; and wherein the maximum diameter of nonmetallic inclusions present in at least in a region extending from the inner surface of the steel pipe to a depth of 20 μm is 20 μm or less.

2. The seamless steel pipe as a fuel injection pipe according to claim 1, further containing, in place of a portion of Fe, at least one selected from among Cr: 1% or less, Mo: 1% or less, Ti: 0.04% or less, Nb: 0.04% or less, and V: 0.1% or less.

* * * * *

UNITED STATES PATENT AND TRADEMARK OFFICE

CERTIFICATE OF CORRECTION

PATENT NO. : 8,147,623 B2
APPLICATION NO. : 12/244641
DATED : April 3, 2012
INVENTOR(S) : Kikuo Asada et al.

It is certified that error appears in the above-identified patent and that said Letters Patent is hereby corrected as shown below:

On the title page, item (73) should read:

(73) Assignee: Usui Kokusai Sangyo Kaisha, Ltd.
Shizuoka (JP)

Sumitomot Metal Industries, Ltd.
Osaka-shi (JP)

Signed and Sealed this
Tenth Day of July, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,147,623 B2
APPLICATION NO. : 12/244641
DATED : April 3, 2012
INVENTOR(S) : Kikuo Asada et al.

It is certified that error appears in the above-identified patent and that said Letters Patent is hereby corrected as shown below:

On the title page, item (73) should read:

(73) Assignee: Usui Kokusai Sangyo Kaisha, Ltd.
Shizuoka (JP)

Sumitomo Metal Industries, Ltd.
Osaka-shi (JP)

This certificate supersedes the Certificate of Correction issued July 10, 2012.

Signed and Sealed this
First Day of January, 2013

David J. Kappos

David J. Kappos
*Director of the United States Patent and Trademark Office*